United States Patent [19]

Yoshizawa et al.

[11] Patent Number: 4,859,552

[45] Date of Patent: Aug. 22, 1989

[54] ELECTROPHOTOGRAPHIC PHOTORECEPTOR WITH SUPERLATTICE STRUCTURE

[75] Inventors: Shuji Yoshizawa; Tatsuya Ikezue, both of Tokyo, Japan

[73] Assignee: Kabushiki Kaisha Toshiba, Kawasaki, Japan

[21] Appl. No.: 156,026

[22] Filed: Feb. 16, 1988

[30] Foreign Application Priority Data

| | | | |
|---|---|---|---|
| Feb. 18, 1987 | [JP] | Japan | 62-34899 |
| Feb. 18, 1987 | [JP] | Japan | 62-34901 |
| Feb. 18, 1987 | [JP] | Japan | 62-34902 |
| Feb. 19, 1987 | [JP] | Japan | 62-36734 |

[51] Int. Cl.[4] ..... G03G 5/082

[52] U.S. Cl. ..... 430/57; 430/60; 430/95

[58] Field of Search ..... 430/57, 60, 89, 95

[56] References Cited

U.S. PATENT DOCUMENTS

| | | | |
|---|---|---|---|
| 4,683,184 | 7/1987 | Osawa et al. | 430/57 |
| 4,722,879 | 2/1988 | Ueno et al. | 430/57 |

FOREIGN PATENT DOCUMENTS

| | | |
|---|---|---|
| 3511315 | 10/1985 | Fed. Rep. of Germany . |
| 3525359 | 1/1986 | Fed. Rep. of Germany . |

*Primary Examiner*—John L. Goodrow

*Attorney, Agent, or Firm*—Foley & Lardner, Schwartz, Jeffery, Schwaab, Mack, Blumenthal & Evans

[57] ABSTRACT

An electrophotographic photoreceptor constituted by a conductive substrate, and a photoconductive layer, provided on the conductive substrate, for generating photocarriers upon radiation of light is disclosed. The photoconductive layer has a charge-generating layer and a charge-retaining layer. The charge-generating layer comprises a semiconductor containing silicon as a major constituent. The charge-retaining layer comprises a multilayered body constituted by alternately stacking first amorphous semiconductor layers containing silicon as a major constituent and second amorphous semiconductor layers containing silicon as a major constituent and at least one element selected from the group consisting of carbon, oxygen, and nitrogen. A concentration of the element is changed in a direction of thickness of the charge-retaining layer for each second amorphous semiconductor layer.

21 Claims, 8 Drawing Sheets

ELECTROPHOTOGRAPHIC PHOTORECEPTOR WITH SUPERLATTICE STRUCTURE

BACKGROUND OF THE INVENTION

1. Field of the Invention

The present invention relates to an electrophotographic photoreceptor for use in electrophotography.

2. Description of the related art including information disclosed under § 1.97–1.99

Amorphous silicon containing hydrogen H (to be referred to as a-Si:H hereinafter) has received a great deal of attention as a photoconductive material, and has been used in a variety of applications, such as solar cells, thin film transistors, image sensors, and electrophotographic photoreceptors.

The materials used as the photoconductive layers in conventional electrophotographic photoreceptors can be categorized as either inorganic (e.g., CdS, ZnO, Se, or Se-Te) or organic (poly-N-vinylcarbazole (PVCZ) or trinitrofluorene). The a-Si:H has many advantages over the above-mentioned conventional organic and inorganic materials, such as that it is non-toxic and does not require recovery, high spectral sensitivity in the range of visible light is guaranteed, and its high surface hardness ensures high resistance to wear, and good anti-impact properties. For this reason, a-Si:H is receiving a great deal of attention as a promising electrophotographic photoreceptor.

The a-Si:H material has been developed as an electrophotographic photoreceptor on the basis of the Carlson system. In this case, good photoreceptor properties mean high dark resistance and high sensitivity to light. However, it is difficult to incorporate these two properties in a signal layer photoreceptor. A barrier layer is arranged between the photoconductive layer and a conductive support, and a surface charge-retaining layer is formed on the photoconductive layer, to constitute a multilayer structure, thereby satisfying the two requirements described above.

The a-Si:H material for use as a photoreceptor is prepared by glow discharge decomposition, using a silane gas. During the fabrication process, hydrogen is incorporated in the a-Si:H film, whereby the electrical and optical characteristics thereof are changed greatly, according to the change in hydrogen content. As the amount of hydrogen incorporated in the a-Si:H film increases, the film's optical band gap widens and its resistance increases. Along with the increase in resistance, the sensitivity to long-wavelength light is degraded. Therefore, it is difficult to use such as an a-Si:H film in a laser beam printer utilizing a semiconductor layer. When the content of hydrogen in the a-Si:H film is high, as described above, most of the components in the film can have bonding structures, such as those in $(SiH_2)n$ and $SiH_2$, depending on film formation conditions. In this case, the number of voids and hence, the number of silicon dangling bonds, increases, thereby degrading the photoconductive characteristics of the film. Under these circumstances, the film cannot be used as an electrophotographic photoreceptor. However, when the content of hydrogen in the a-Si:H film is low, the optical band gap is narrow and the resistance lower. As a result, the sensitivity to short-wavelength light is increased. A small content of hydrogen causes bonding of hydrogen atoms with the silicon dangling bonds, thus reducing the number of silicon dangling bonds. For this reason, the mobility of photocarriers is degraded, thereby shortening their lifetime. At the same time, the photoconductive property of the film is degraded and the film cannot be used as an electrophotographic photoreceptor.

SUMMARY OF THE INVENTION

It is an object of the present invention to provide an electrophotographic photoreceptor having good charge retaining property, dark attenuation property, photosensitivity, and environmental resistance property.

According to a first embodiment of the present invention, there is provided an electrophotographic photoreceptor comprising a conductive substrate, and a photoconductive layer, formed on the conductive substrate, for generating photocarriers upon radiation of light, wherein the photoconductive layer has a charge-generating layer and a charge-retaining layer, the charge-generating layer comprises a semiconductor containing silicon as a major constituent, the charge-retaining layer comprises a multilayered body constituted by alternately stacking first amorphous semiconductor layers containing silicon as a major constituent and second amorphous semiconductor layers containing silicon as a major constituent and at least one element selected from the group consisting of carbon, oxygen, and nitrogen, and a concentration of the element is changed in a direction of thickness of the charge-retaining layer for each second amorphous semiconductor layer.

The charge-retaining layer in the first embodiment can be formed of amorphous silicon and/or microcrystalline silicon. The charge generating layer can be formed by stacking a plurality of microcrystalline silicon layers having different crystallinities. Alternatively, the charge-generating layer can be formed by alternately stacking amorphous silicon layers and microcrystalline silicon layers.

According to a second embodiment of the present invention, there is provided an electrophotographic photoreceptor comprising a conductive substrate, and a photoconductive layer, formed on the conductive substrate, for generating photocarriers upon radiation of light, wherein the photoconductive layer has a charge-generating layer and a charge-retaining layer, the charge-generating layer comprises a multilayered body constituted by alternately stacking amorphous semiconductor layers containing silicon as a major constituent and microcrystalline silicon layers containing silicon as a major constituent, a crystallinity of the microcrystalline silicon layers is changed in a direction of thickness of the charge-generating layer for each microcrystalline silicon layer, and the charge-retaining layer comprises a first amorphous semiconductor layer containing silicon as a major constituent and a second amorphous silicon layer containing silicon as a major constituent and at least one element selected from the group consisting of carbon, oxygen, and nitrogen.

In the second embodiment, the crystallinity of the microcrystalline semiconductor layers is preferably changed within a range of 60 to 90%.

In the first and second embodiments, the content of the element in the second amorphous semiconductor layer preferably falls within a range of 0.5 to 30 atomic % and, more preferably, 5 to 30 atomic %.

In the first and second embodiments, the film thickness of each of layers constituting the multilayered body preferably falls within the range of 30 to 500 Å.

A microcrystalline semiconductor containing silicon as a major constituent, that is, microcrystalline silicon con (μc-Si) is thought to be formed by a mixture phase of amorphous silicon and microcrystalline silicon having a particle diameter of several tens of angstrom and has the following physical properties. First, microcrystalline silicon has a diffraction pattern for 2θ of 28° to 28.5° according to X-ray diffractiometry and can be clearly distinguished from amorphous Si causing only a halo. Second, a dark resistance of μc-Si can be adjusted to be $10^{10}$ Ω·cm or more and can be clearly distinguished from polycrystalline silicon having a dark resistance of $10^5$ Ω·cm.

An optical band gap (Eg°) of μc-Si used in the present invention can be arbitrarily set to fall within a predetermined range. The optical band gap is preferably set to be, e.g., 1.55 eV. In this case, in order to obtain a desirable Eg°, hydrogen is preferably added to obtain μc-Si:H.

In the electrophotographic photoreceptor according to the present invention, the content of hydrogen in a-Si:H and μc-Si:H is preferably 0.01 to 30 atomic % and more preferably 1 to 25 atomic %. This amount of hydrogen compensates for dangling bonds of silicon and provides a good balance between the dark resistance and the bright resistance, thereby improving the photoconductive property.

An a-Si:H layer can be formed such that a silane series gas such as $SiH_4$ or $Si_2H_4$ as a raw or source gas is supplied to a reaction chamber and a high-frequency power is supplied to the raw gas to cause glow discharge. In this case, hydrogen or helium gas as a carrier, as needed. However, the material of the source gas is not limited to a silane series gas but can be replaced with a silicon halide gas (e.g., $SiF_4$ or $SiCl_4$) or a mixture of a silane series gas and a silicon halide gas. The a-Si:H layer can be formed not only by the glow discharge method but also by a physical method such as sputtering.

A μc-Si layer can be formed by the high-frequency glow discharge method using silane gas as a raw gas in the same manner as in the a-Si:H layer. In this case, if a film formation temperature is higher than that of the a-Si:H layer, and a high-frequency power for the μc-Si layer is also higher than that of the a-Si:H layer, a μc-Si:H layer is easily formed. Furthermore, when a higher substrate temperature and a higher high-frequency power are used, a flow rate of the raw gas such as silane gas can be increased. As a result, the film formation rate can be increased. Furthermore, when a gas prepared by diluting a silane gas of a higher order (e.g., $SiH_4$ or $Si_2H_6$) with hydrogen is used, a μc-Si:H layer can be formed with higher efficiency.

In order to obtain p-type μc-Si:H and a-Si:H, elements belonging to the Group III of the Periodic Table, such as boron (B), aluminum (Al), gallium (Ga), indium (In), and thallium (Tl) are doped in μc-Si:H and a-Si:H. In order to obtain n-type μc-Si:H and a-Si:H elements belonging to Group V of the Periodic Table, such as nitrogen (N), phosphorus (P), arsenic (As), antimony (Sb), and bismuth (Bi) are preferably doped in μc-Si:H and a-Si:H. Doping of the p- or n-type impurity prevents movement of charges from the substrate to the photoconductive layer. When at least one element selected from the group consisting of carbon (C), nitrogen (N), and oxygen (O) is contained in μc-Si:H and a-Si:H, the resultant layers have a high resistance and a high surface charge retaining capacity.

As described above, in the electrophotographic photoreceptor, at least part of the photoconductive layer is constituted by the plurality of stacked thin layers having different optical band gaps. In this manner, since the thin layers having different optical band gaps are stacked, a superlattice structure can be obtained such that a layer having a larger optical band gap serves as a barrier with respect to a layer having a small optical band gap irrespective of the absolute magnitudes of the optical band gaps so as to constitute a periodic potential barrier pattern. In the superlattice structure, since the layers constituting the barrier are very thin, carriers can pass through the barrier and move in the superlattice structure by the tunnel effect of the carriers in the thin layers. In addition, in such a superlattice structure, a large number of carriers are generated, and they have a long lifetime and a high mobility. For these reasons, the sensitivity of the electrophotographic photoreceptor can be greatly improved. The mechanism for this improvement cannot be perfectly clarified. However, the improvement may be regarded as a quantum effect by a periodic well type potential unique to the superlattice structure. This effect is called a superlattice effect.

By changing the band gap and thickness of the thin layer in the superlattice structure, the apparent band gap may be arbitrarily adjusted.

DETAILED DESCRIPTION OF THE PREFERRED EMBODIMENTS

Various embodiments of the present invention will now be described in detail with reference to the accompanying drawings.

Figure 1:
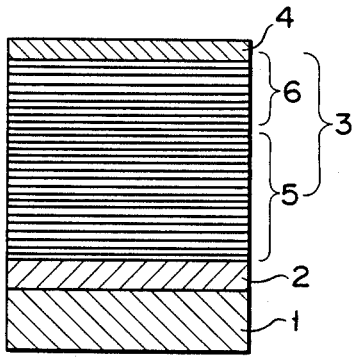
FIG. 1 is a sectional view of an electrophotographic photoreceptor according to one embodiment of the present invention.

FIG. 1 is a sectional view of electrophotographic photoreceptors, according to first and second embodiments of the present invention.

In the electrophotographic photoreceptor shown in FIG. 1, barrier layer 2 is formed on conductive substrate 1, photoconductive layer 3 consisting of charge-retaining layer 5 and charge-generating layer 6 formed on barrier layer 2, and surface layer 4 is formed on photoconductive layer 3. Charge-retaining layer 5 and charge-generating layer 6 have a superlattice structure.

Figure 2:
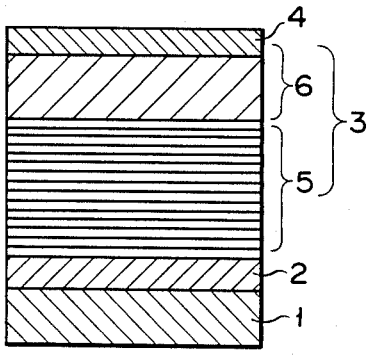
FIG. 2 shows a modification of an electrophotographic photoreceptor according to the embodiment of FIG. 1.

FIG. 2 shows a modification of an electrophotographic photoreceptor, according to the first embodiment of the present invention.

In the electrophotographic photoreceptor shown in FIG. 2, only charge-retaining layer 5 has a superlattice structure.

The details of the parts in the first and second embodiments shown in FIGS. 1 and 2 are as follows.

Conductive substrate 1 is normally an aluminum drum.

Barrier layer 2 may be formed using μc-Si, a-Si:H, or a-BN:H (nitrogen- or hydrogen-doped amorphous boron). Barrier layer 2 may be made of an insulating film. For example, at least one element selected from the group consisting of carbon (C), nitrogen (N), and oxygen (O) is contained in μc-Si:H or a-Si:H to form an insulating barrier layer having a high resistance. The thickness of barrier layer 2 is preferably 100 Å to 10 μm.

Barrier layer 2 restricts a flow of a charge between conductive substrate 1 and photoconductive layer 3 (or charge-generating layer 6) to improve a charge-retaining capacity on the surface of the photoconductive layer and to improve a charging capacity of the photoconductive layer. Therefore, when a Carlson photoreceptor is manufactured using a semiconductor layer as a barrier layer, barrier layer 2 must have a p or n conductivity type so as not to degrade the charge-retaining capacity of the surface. More specifically, in order to positively charge the surface of the photoreceptor, p-type barrier layer 2 is formed to prevent an injection of electrons into the photoconductive layer for neutralizing the surface charge. However, in order to negatively charge the surface, n-type barrier layer 2 is formed to prevent an injection of holes for neutralizing the surface charge into the photoconductive layer. Carriers injected from barrier layer 2 serve as noise for carriers generated in photoconductive layers 3 and 6 upon the radiation of light. By preventing the carrier injections described above, the sensitivity of the photoconductive layers can be improved. In order to obtain p-type μc-Si:H or p-type a-Si:H, elements belonging to Group III of the Periodic Table, such as boron (B), aluminum (Al), gallium (Ga), indium (In), and thallium (Tl) are preferably doped in μc-Si:H or a-Si:H. In order to obtain n-type μc-Si:H or n-type a-Si:H, elements belonging to Group V of the Periodic Table, such as nitrogen (N), phosphorus (P), arsenic (As), antimony (Sb), and bismuth (Bi) are preferably doped in μc-Si:H or a-Si:H.

In the electrophotographic photoreceptor shown in FIG. 1, charge-generating layer 6 generates carriers upon the reception of incident light. The carriers having one polarity are neutralized with the charge on the surface of the photoreceptor, and the carriers having the other polarity are moved through charge-retaining layer 5 up to conductive substrate 1.

Figure 3:
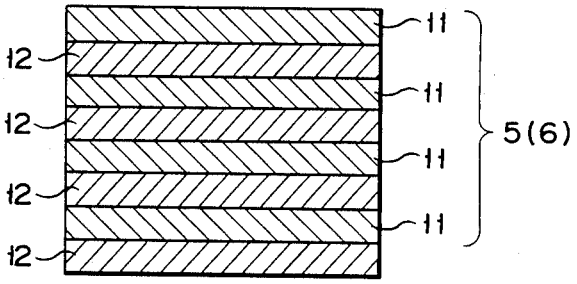
FIG. 3 is a sectional view showing part of FIGS. 1 and 2 in an enlarged scale.

In the first and second embodiments shown in FIG. 1, charge-retaining layer 5 and charge-generating layer 6 each have a superlattice structure obtained by alternately stacking first and second thin layers 11 and 12, as shown in FIG. 3.

In the first embodiment shown in FIG. 1, charge-retaining layer 5 comprises a multilayered body by alternately stacking first a-Si layers 11 and second a-Si layers 12 containing at least one element selected from the group consisting of C, O, and N. In this case, a concentration of the element is changed in a direction of thickness of charge-retaining layer 5 for each second a-Si layer 12. Charge-generating layer 6 comprises a multilayered body constituted by alternately stacking a plurality of μc-Si layers 11 and 12 having different crystallinities, or alternately stacking a-Si layers 11 and μc-Si layers 12.

In a modification of the first embodiment shown in FIG. 2, the same charge-retaining layer 5 as in the first embodiment shown in FIG. 1 is used. Charge-generating layer 6 contains a-Si and/or μc-Si, and has no superlattice structure.

In the second embodiment shown in FIG. 1, charge-retaining layer 5 comprises a multilayered body constituted by alternately stacking first a-Si layers 11 and second a-Si layers 12 containing at least one element selected from the group consisting of C, O, and N. Charge-generating layer 6 comprises a multilayered body constituted by alternately stacking a-Si layers 11 and μc-Si layers 12. The crystallinity of μc-Si layer 12 is changed in a direction of thickness of the charge-generating layer for each μc-Si layer 12.

The thickness of thin layers 11 and 12 falls within the range of 30 to 500 Å.

Figure 4:
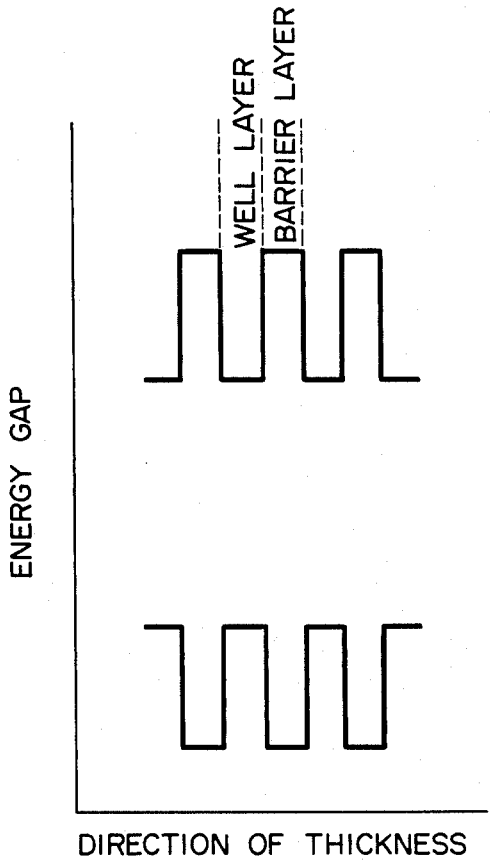
FIG. 4 is a view showing an energy band of the superlattice structure.

FIG. 4 is a graph showing an energy band of the superlattice structure. The direction of thickness is plotted along the ordinate, and the optical band gap is plotted along the abscissa.

Surface layer 4 is formed on charge-generating layer 6. The refractive index of μc-Si:H or a-Si:H, constituting charge-generating layer 6, is as relatively large as 3 to 3.4, and reflection tends to occur on the surface of the layer. When such reflection occurs, the amount of light to be absorbed in the charge-generating layer is decreased, and optical loss typically occurs. For this reason, surface layer 4 is preferably formed to prevent light reflection. In addition, surface layer 4 prevents charge-generating layer 6 from being damaged. Furthermore, the formation of the surface layer allows for the improvement of the charging capacity, and the surface can be satisfactorily charged. A material of the surface layer is an inorganic compound (e.g., a-SiN:H, a-SiO:H, or a-SiC:H) or an organic material (e.g., polyvinyl chloride or polyamide).

Figure 5:
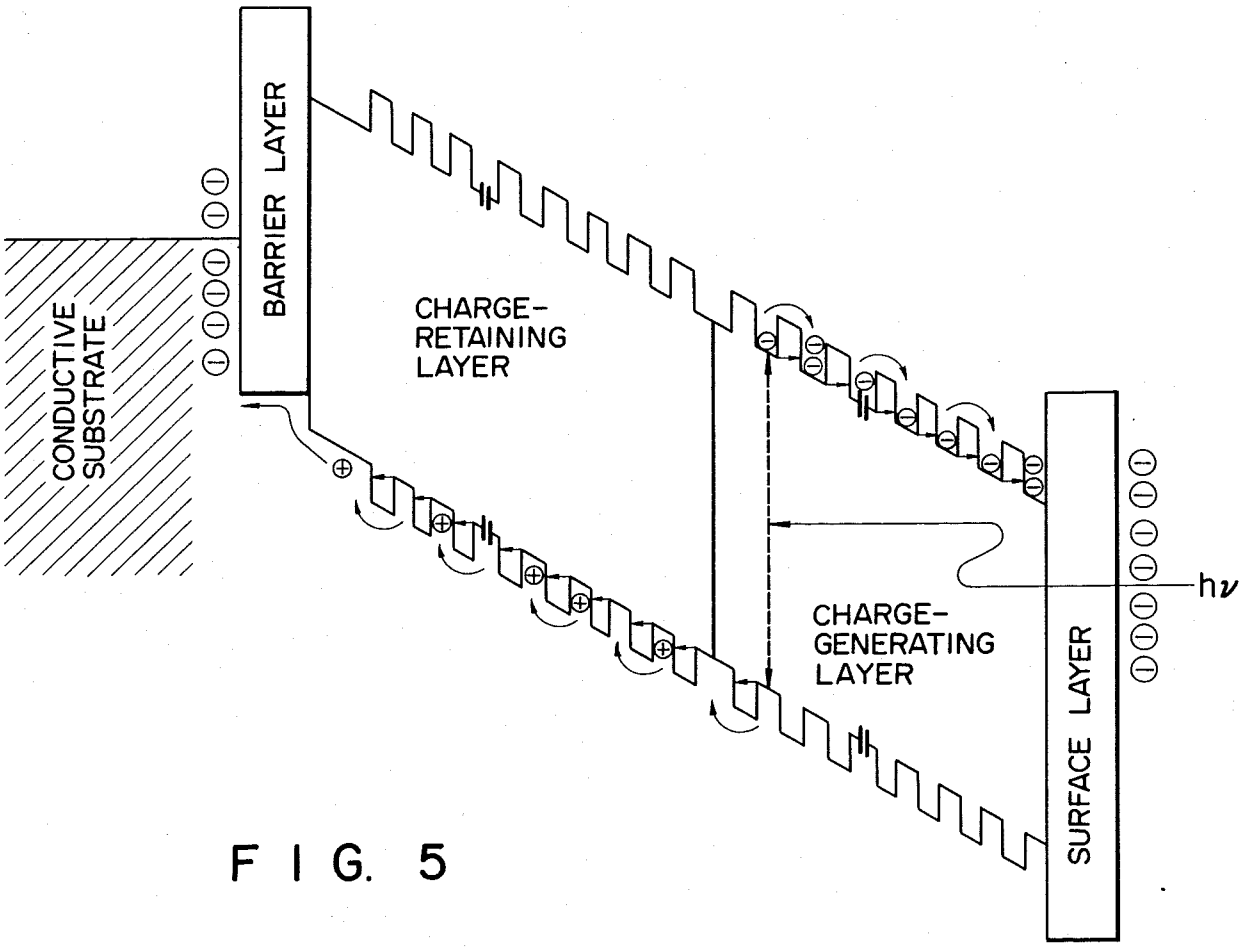
FIG. 5 is a schematic view of an energy gap of a photoreceptor according to the present invention.

When the surface of the electrophotographic photoreceptor shown in FIG. 1 is positively charged by corona discharge with a voltage of about 500 V, a potential barrier shown in FIG. 5 is formed. When light (hv) is incident on the photoconductive layer, carrier, i.e., electrons and holes, are generated in the superlattice structure of charge-generating layer 6. The electrons in the conduction band are accelerated toward surface layer 4 by an electric field in the photoreceptor, while the holes are accelerated toward conductive substrate 1. In this case, the number of carriers generated at an interface between the adjacent thin layers having different optical band gaps is larger than that generated in the bulk. For this reason, in this superlattice structure, high light sensitivity can be obtained. In the potential well layer, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement.

Also in the potential well layer of charge-retaining layer 5, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement.

As described above, according to the electrophotographic photoreceptor having the charge-retaining layer of the superlattice structure wherein thin layers having different optical band gaps are stacked, a good photoconductive property can be obtained, and therefore a clearer image can be obtained as compared with a conventional photoreceptor.

Figure 6:
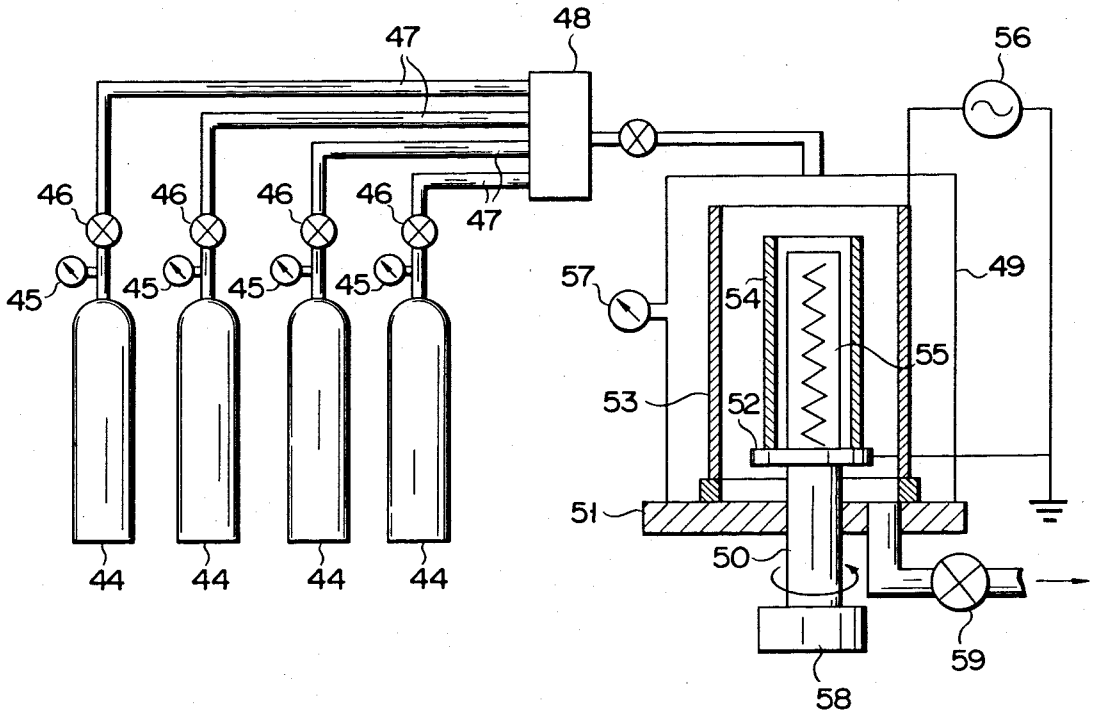
FIG. 6 is a view of an apparatus for manufacturing an electrophotographic photoreceptor of the present invention.
Figure 7A:
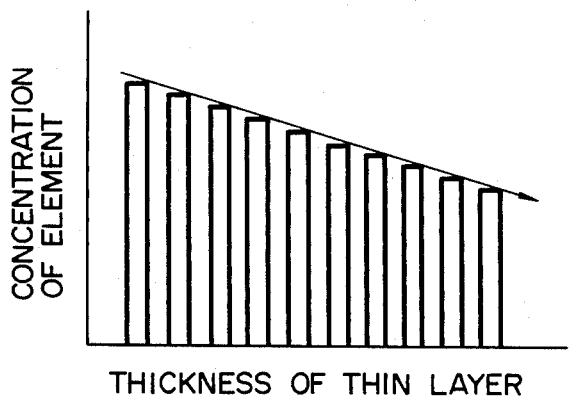
FIGS. 7A to 7F are graphs showing change in concentration of element contained in thin layers.
Figure 7B:
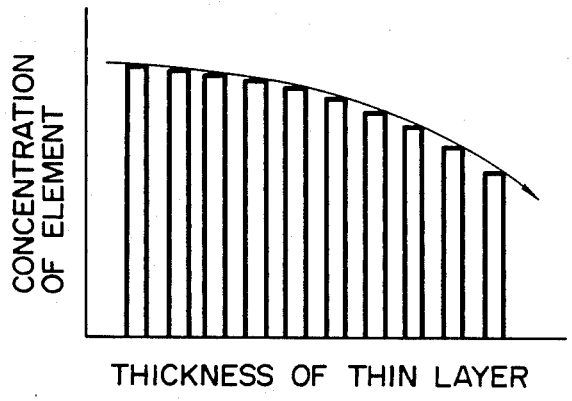
Figure 7C:
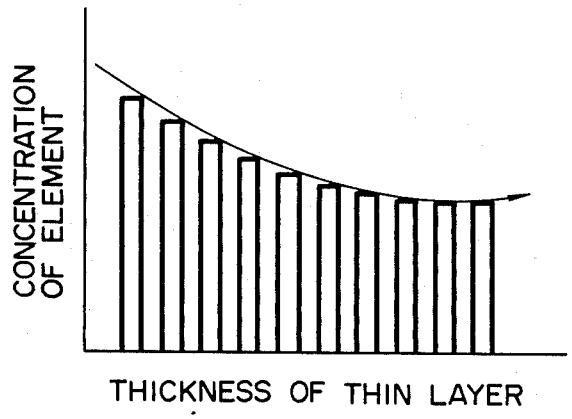
Figure 7D:
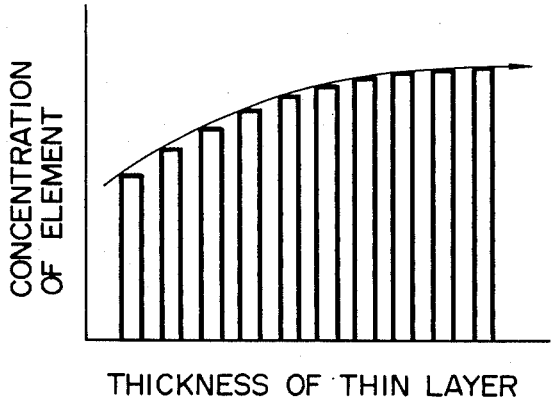
Figure 7E:
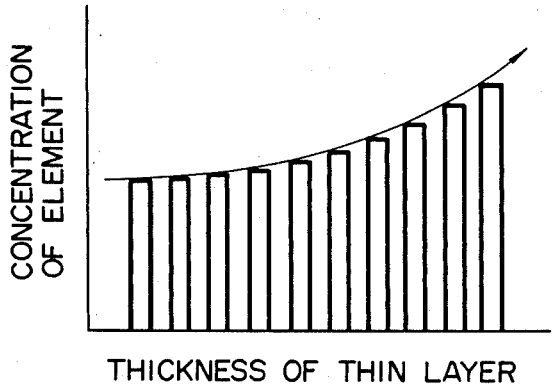
Figure 7F:
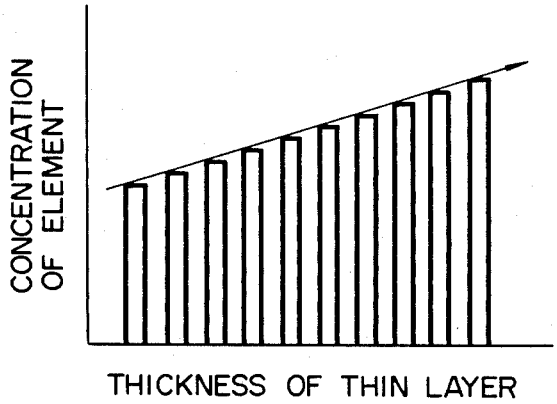
Figure 8A:
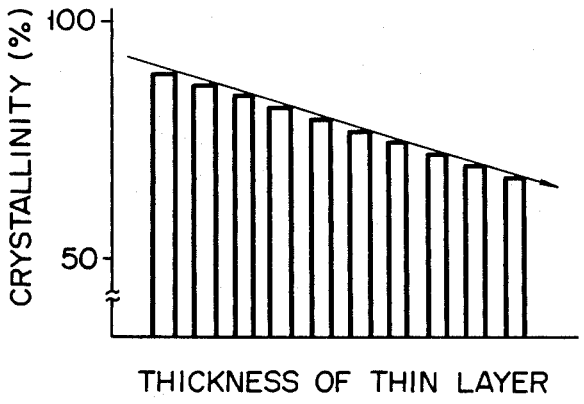
FIGS. 8A to 8F are graphs showing change in crystallinity of microcrystalline silicon layers.
Figure 8B:
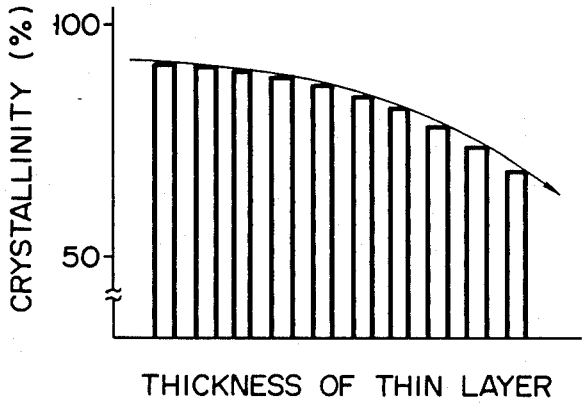
Figure 8C:
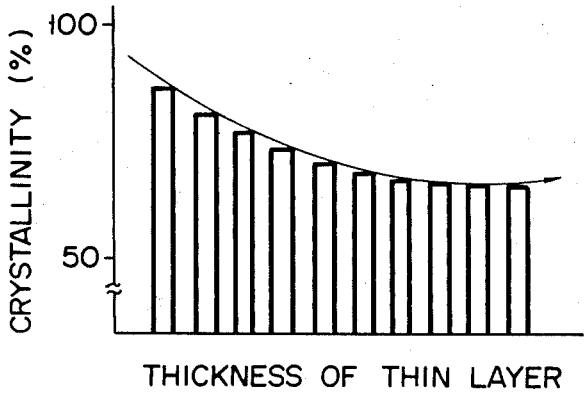
Figure 8D:
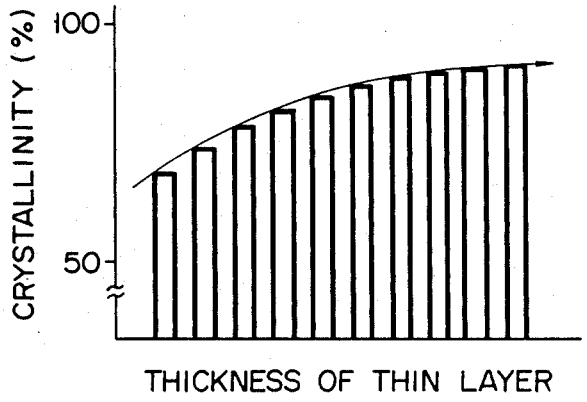
Figure 8E:
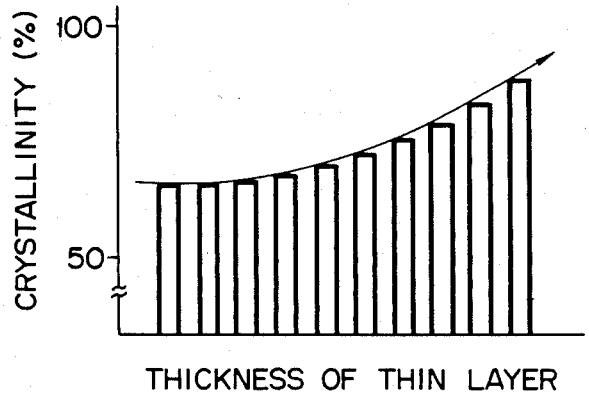
Figure 8F:
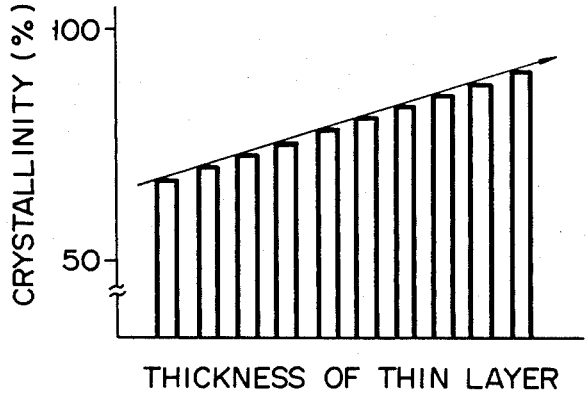

FIG. 6 shows an apparatus for manufacturing an electrophotographic photoreceptor according to the present invention, utilizing the glow discharge method. Gas cylinders 41, 42, 43, and 44 store source gases such as $SiH_4$, $B_2H_6$, $H_2$, and $CH_4$. Gases in cylinders 41, 42, 43, and 44 can be supplied to mixer 48, through flow control valves 46 and pipes 47 respectively. Each cylinder has pressure gauge 45. The operator controls each valve 46 while monitoring corresponding pressure gauge 45, thereby controlling the flow rate of each gas and their mixing ratio. The gas mixture is supplied from mixer 48 to reaction chamber 49. Rotating shaft 10 vertically extends from bottom 11 of reaction chamber 49, and can be rotated about the vertical axis. Disk-like support table 52 is fixed on the upper end of shaft 50 such that the surface of table 52 is perpendicular to shaft 50. Cylindrical electrode 3 is arranged inside chamber 49 such a that the axis of electrode 53 is aligned with the axis of shaft 50. Drum-like substrate 54 for a photoreceptor is placed on table 52 such that the axis of the former is aligned with the axis of shaft 50. Drum-like substrate heater 55 is arranged inside substrate 54. RF power source 56 is connected between electrode 53 and substrate 54, and supplies an RF current therebetween. Rotating shaft 50 is driven by motor 58. The internal pressure of reaction chamber 49 is monitored by pressure gauge 57, and chamber 49 is connected to a proper evacuating means, such as a vacuum pump, through gate valve 59.

In order to manufacture a photoreceptor in the apparatus having the construction described above, drum-like substrate 14 is placed in reaction chamber 49, and gate valve 59 is opened to evacuate chamber 49 to a vacuum of about 0.1 Torr or less. The predetermined gases from cylinders 41, 42, 43, and 44 are supplied to chamber 49, at a predetermined mixing ratio. In this case, the flow rates of the gases supplied to chamber 49 are determined such that the internal pressure of chamber 49 is set to be 0.1 to 1 Torr. Motor 58 is operated to rotate substrate 54. Substrate 54 is heated to a predetermined temperature by heater 55, and an RF current is supplied between electrode 53 and substrate 14, thereby generating a glow discharge therebetween. An a-Si:H layer is deposited on substrate 54. $N_2O$, $NH_3$, $NO_2$, $N_2$, $CH_4$, $C_2H_4$, and $O_2$ gases and the like may be added to the feed gas to add the element N, C, or O in the a-Si:H layer.

As is apparent from the above description, the electrophotographic photoreceptor according to the present invention can be manufactured in a closed-system manufacturing apparatus, thus guaranteeing the safety of the operators. Since the electrophotographic photoreceptor has high resistance to heat, to humidity, and to wear, repeated use thereof does not result in degradation; thus, a long service life is assured.

Electrophotographic photoreceptors according to the present invention were formed, and their electrophotographic characteristics were tested in the following manner.

EXAMPLE 1

An aluminum drum substrate having a diameter of 80 mm and a length of 350 mm and subjected to acid, alkali, and sandblast treatments as needed to prevent interference, was mounted in a reaction chamber, and the interior of the reaction chamber was exhausted by a diffusion pump (not shown) to obtain a vacuum pressure of about $10^{-5}$ Torr. Thereafter, the drum substrate was heated to a temperature of 250° C. and rotated at 10 rpm, and an $SiH_4$ gas with a flow rate of 500 SCCM, a B2H6 gas with a ratio of flow rate of $10^{-5}$ with respect to the $SiH_4$ gas, and a $CH_4$ gas with a flow rate of 100 SCCM were supplied into the reaction chamber, so that the interior of the reaction chamber was adjusted to be 1 Torr. Then, a high-frequency electric power of 13.56 MHz was applied to an electrode to generate plasma of $SiH_4$, $B_2H_6$, and $CH_4$ between the electrode and the substrate, thereby forming a barrier layer consisting of p-type a-SiC:H.

Next, an $SiH_4$ gas with a flow rate of 500 SCCM and a $CH_4$ gas with a flow rate of 30 SCCM were supplied into the reaction chamber, and a high-frequency electric power of 400 W was applied to form a 120-Å a-SiC:H thin layer. The flow rate of the $CH_4$ gas was set to be 0, and a $B_2H_6$ gas with a ratio of flow rate of $10^{-6}$ with respect to the $SiH_4$ gas was supplied into the reaction chamber. The high-frequency electric power of 400 W was similarly applied to form a 120-Å a-Si:H thin layer. Upon repetition of the above operation, a 12-μm charge-retaining layer of a superlattice structure consisting of 500 a-SiC:H thin layers and 500 a-Si:H thin layers was formed. Upon formation of the a-SiC:H thin layers, the flow rate of the $CH_4$ gas was gradually reduced each time a thin layer was formed, and was finally reduced to 10 SCCM, thereby changing a concentration of carbon from 6 atomic % to 2 atomic %.

An $SiH_4$ gas with a flow rate of 100 SCCM and an $H_2$ gas with a flow rate of 1.2 SLM were introduced into the reaction chamber, so that the interior of the reaction chamber was adjusted to 1.2 Torr. Then, a high-frequency electric power of 1.0 kW was applied to form a 100-Å μc-Si:H thin layer. The crystallinity of this thin layer was 85%. Then, a high-frequency electric power of 600 W was applied to similarly form a 100-Å μc-Si:H thin layer. The crystallinity of this thin layer was 65%. Upon repetition of the above operation, a 5-μm charge-generating layer of a superlattice structure consisting of a combination of a plurality of sets of 200 μc-Si:H thin layers each set having different crystallinity was formed.

Finally, a surface layer comprising a 0.5-μm a-SiC:H thin layer was formed.

When the photoreceptor surface thus formed was positively charged at about 500 V and exposed to white light, the light was absorbed in the charge-generating layer, and photocarriers of electron-hole pairs were generated. In this test example, a large number of photocarriers were generated, and a long lifetime and high propagating property of photocarriers were obtained.

As a result, a clear image of high quality was obtained. In addition, when the photoreceptor manufactured in this test example was repeatedly charged, a transferred image was proved to have very good reproducibility and stability and superior durabilities such as high resistance to corona, humidity, and wear. Furthermore, the photoreceptor thus manufactured has a high sensitivity to light having a long wavelength of 780 to 790 mn which is an oscillation wavelength of a semiconductor laser. When the photorereptor was mounted in a semiconductor laser printer to form an image by the Carlson process, a clear image was obtained with high resolution even when an exposure amount of the photoreceptor was 25 erg/cm$^2$.

EXAMPLE 2

Following the same procedures as in Example 1, an electrophotographic photoreceptor was manufactured except that a-SiN:H thin layers were formed in place of a-SiC:H thin layers as one of constituting layers of a charge-retaining layer.

Note that the a-SiN:H thin layer was obtained such that an $SiH_4$ gas with a flow rate of 500 SCCM and an $N_2$ gas with a flow rate of 80 SCCM were supplied into the reaction chamber and a high-frequency electric power of 500 W was applied thereto. In this case, the flow rate of the $N_2$ gas was gradually reduced for formation of each thin layer, and was finally set to be 30 SCCM, thus changing a concentration of nitrogen from 5 atomic % to 1 atomic %.

An image was formed using the photoreceptor of this Example following the same procedures as in Example 1. As a result, a clear image of high quality was obtained.

EXAMPLE 3

Following the same procedures as in Example 1, electrophotographic photoreceptors were manufactured except that a concentration of carbon of a-SiC:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 4

Following the same procedures as in Example 2, electrophotographic photoreceptors were manufactured except that a concentration of nitrogen of a-SiN:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 5

Following the same procedures as in Example 1, an electrophotographic photoreceptor was manufactured except that a charge-generating layer was formed as follows.

More specifically, an $SiH_4$ gas with a flow rate of 500 SCCM and a $B_2H_6$ gas with a ratio of flow rate of $10^{-6}$ with respect to the $SiH_4$ gas were supplied into the reaction chamber, and a high-frequency electric power of 300 W was applied thereto, thereby forming a 50-Å a-Si:H thin layer. Then, an $SiH_4$ gas with a flow rate of 100 SCCM and an $H_2$ gas with a flow rate of 1.2 SLM were supplied into the reaction chamber, so that the interior of the reaction chamber was adjusted to 1.2 Torr. Then, a high-frequency electric power of 1.0 kW was applied to form a 100-Å μc-Si:H thin layer. Upon repetition of the above operation, a 3-μm charge-generating layer of a superlattice structure consisting of 200 a-Si:H thin layers and 200 μc-Si:H thin layers.

An image was formed using these photoreceptors following the same procedures as in Example 1. As a result, a clear image of high quality was obtained.

EXAMPLE 6

Following the same procedures as in Example 5, an electrophotographic photoreceptor was manufactured except that a-SiN:H thin layers were formed in place of a-SiC:H thin layers as one of constituting layers of a charge-retaining layer.

Note that the a-SiN:H thin layer was obtained such that an $SiH_4$ gas with a flow rate of 500 SCCM and an $N_2$ gas with a flow rate of 80 SCCM were supplied into the reaction chamber and a high-frequency electric power of 500 W was applied thereto. In this case, the flow rate of the $N_2$ gas was gradually reduced for formation of each thin layer, and was finally set to be 30 SCCM, thus changing a concentration of nitrogen from 5 atomic % to 1 atomic %.

An image was formed using the photoreceptor of this Example following the same procedures as in Example 1. As a result, a clear image of high quality was obtained.

EXAMPLE 7

Following the same procedures as in Example 5, a superlattice structure electrophotographic photoreceptors were manufactured except that a concentration of carbon of a-SiC:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 8

Following the same procedures as in Example 6, electrophotographic photoreceptors were manufactured except that a concentration of nitrogen of a-SiN:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 9

Following the same procedures as in Example 1, an electrophotographic photoreceptor was manufactured except that a charge-generating layer was formed as follows.

More specifically, an $SiH_4$ gas with a flow rate of 500 SCCM and a $B_2H_6$ gas with a ratio of flow rate of $10^{-6}$ with respect to the $SiH_4$ gas was supplied to the reaction chamber, and a high-frequency power of 300 W was applied, thus forming a charge-generating layer comprising a 3-μm i-type a-Si:H thin layer.

An image was formed using the photoreceptor of this Example following the same procedures as in Example 1. As a result, a clear image of high quality was obtained.

EXAMPLE 10

Following the same procedures as in Example 9, an electrophotographic photoreceptor was manufactured except that a-SiN:H thin layers were formed in place of a-SiC:H thin layers as one of constituting layers of a charge-retaining layer.

Note that the a-SiN:H thin layer was obtained such that an $SiH_4$ gas with a flow rate of 500 SCCM and an $N_2$ gas with a flow rate of 80 SCCM were supplied into the reaction chamber and a high-frequency electric power of 500 W was applied thereto. In this case, the flow rate of the $N_2$ gas was gradually reduced for formation of each thin layer, and was finally set to be 30 SCCM, thus changing a concentration of nitrogen from 5 atomic % to 1 atomic %.

An image was formed using the photoreceptor of this Example following the same procedures as in Example 1. As a result, a clear image of high quality was obtained.

EXAMPLE 11

Following the same procedures as in Example 9, an electrophotographic photoreceptor was manufactured except that a μc-Si layer was formed in place of the a-SiC:H layer constituting the charge-generating layer.

Note that the μc-Si layer was formed such that an $SiH_4$ gas with a flow rate of 100 SCCM and an $H_2$ gas with a flow rate of 500 SCCM were supplied into the reaction chamber, so that the interior of the reaction chamber was adjusted to 1.2 Torr, and a high-frequency electric power of 800 W was applied.

An image was formed using the photoreceptor of this Example following the same procedures as in Example 1. As a result, a clear image of high quality was obtained.

EXAMPLE 12

Following the same procedures as in Example 9, electrophotographic photoreceptors were manufactured except that a concentration of carbon of a-SiC:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 13

Following the same procedures as in Example 10, electrophotographic photoreceptors were manufactured except that a concentration of nitrogen of a-SiN:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 14

Following the same procedures as in Example 11, 1 electrophotographic photoreceptors were manufactured except that a concentration of carbon of a-SiC:H layers as one of constituting layers of the charge-retaining layer was changed at a ratio as shown in FIGS. 7A to 7F.

An image was formed using these photoreceptors following the same procedures as in Example 1. As a result, a clear image of high quality was obtained.

EXAMPLE 15

Following the same procedures as in Example 1, an electrophotographic photoreceptor was manufactured except that a charge-retaining layer and a charge-generating layer were formed as follows.

More specifically, an $SiH_4$ gas with a flow rate of 500 SCCM and a $CH_4$ gas with a flow rate of 30 SCCM were supplied into a reaction chamber, and a high-frequency power of 400 W was applied thereto, thereby forming a 120-Å a-SiC:H thin layer. Then, the flow rate of the $CH_4$ gas was set to be 0, and a $B_2H_6$ gas with a ratio of flow rate of $10^{-6}$ with respect to the $SiH_4$ gas was supplied to the reaction chamber, and a high-frequency electric power of 400 W was similarly applied, thus forming a 120-Å i-type a-Si:H thin layer. Upon repetition of the above operation, a 12-μm charge-retaining layer of a superlattice structure consisting of 500 a-SiC:H thin layers and 500 i-type a-Si:H thin layers was formed.

An $SiH_4$ gas with a flow rate of 50 SCCM and an $H_2$ gas with a flow rate of 500 SCCM were supplied into the reaction chamber, so that the interior of the reaction chamber was adjusted to 1 Torr. Then, a high-frequency electric power of 1.2 kW was applied, thus forming a 100-Å μc-Si:H thin layer. The crystallinity of this thin layer was 80%. An $SiH_4$ gas with a flow rate of 500 SCCM and a $B_2H_6$ gas with a ratio of flow rate of $10^{-6}$ with respect to the $SiH_4$ gas were supplied into the reaction chamber, and a high-frequency electric power of 500 W was applied thereto, thereby forming a 50-Å a-Si thin layer. Upon repetition of the above operation, a 3-μm charge-generating layer of a superlattice structure was formed. Upon formation of the μc-Si:H thin layer, a high-frequency electric power was gradually reduced each time a thin layer was formed, and was finally set to be 700 W, thereby changing a crystallinity from 80% to 60%.

An image was formed using the photoreceptor of this Example following the same procedures as in Example 1. As a result, a clear image of high quality was obtained.

EXAMPLE 16

Following the same procedures as in Example 15, an electrophotographic photoreceptor was manufactured except that a-SiN:H thin layers were formed in place of the a-SiC:H thin layers as one of constituting layers of the charge-retaining layer.

Note that the a-SiN:H thin layers were obtained such that an $SiH_4$ gas with a flow rate of 500 SCCM and an $N_2$ gas with a flow rate of 80 SCCM were supplied into the reaction chamber and a high-frequency electric power of 500 W was applied.

An image was formed using the photoreceptor of this Example following the same procedures as in Example 1. As a result, a clear image of high quality was obtained.

EXAMPLE 17

Following the same procedures as in Example 15, electrophotographic photoreceptors were manufactured except that a crystallinity of μc-Si:H thin layers as one of constituting layers of the charge-generating layer was changed at a ratio as shown in FIGS. 8A to 8F.

An image was formed using these photoreceptors following the same procedures as in Example 1. As a result, a clear image of high quality was obtained.

EXAMPLE 18

Following the same procedures as in Example 16, electrophotographic photoreceptors were manufactured except that a crystallinity of μc-Si:H thin layers as one of constituting layers of the charge-generating layer was changed at a ratio as shown in FIGS. 8A to 8F.

An image was formed using these photoreceptors following the same procedures as in Example 1. As a result, a clear image of high quality was obtained.

The number of types of the thin films is not limited to two as in the above examples, but three or more types of thin layers may be stacked. More specifically, a boundary need only be formed between thin layers having optical band gaps which are different from each other.

What is claimed is:

1. An electrophotographic photoreceptor comprising a conductive substrate, and a photoconductive layer, provided on said conductive substrate, for generating photocarriers upon radiation of light, wherein said photoconductive layer has a charge-generating layer and a charge-retaining layer, said charge-generating layer comprises a semiconductor containing silicon as a major constituent, said charge-retaining layer comprises a multilayered body constituted by alternately stacking first amorphous semiconductor layers containing silicon as a major constituent and second amorphous semiconductor layers containing silicon as a major constituent and at least one element selected from the group consisting of carbon, oxygen, and nitrogen, and a concentration of said element is changed in a direction of thickness of said charge-retaining layer for each second amorphous semiconductor layer.

2. An electrophotographic photoreceptor according to claim 1, wherein each of said first and second amorphous semiconductor layers has a thickness falling within the range of 30 to 500 Å.

3. An electrophotographic photoreceptor according to claim 1, wherein the concentration of said element contained in each of said second amorphous semiconductor layer falls within the range of 0.5 to 30 atomic %.

4. An electrophotographic photoreceptor according to claim 3, wherein the concentration of said element contained in each of said second amorphous semiconductor layer falls within the range of 5 to 30 atomic %.

5. An electrophotographic photoreceptor according to claim 1, wherein said charge-generating layer contains amorphous silicon and/or microcrystalline silicon.

6. An electrophotographic photoreceptor comprising a conductive substrate, and a photoconductive layer, provided on said conductive substrate, for generating photocarriers upon radiation of light, wherein said photoconductive layer has a charge-generating layer and a charge-retaining layer, said charge-generating layer comprises a semiconductor containing silicon as a major constituent, said charge-retaining layer comprises a multilayered body constituted by alternately stacking first amorphous semiconductor layers containing silicon as a major constituent and a second amorphous semiconductor layers containing silicon as a major constituent and at least one element selected from the group consisting of carbon, oxygen, and nitrogen, and a concentration of said element is changed in a direction of thickness of said charge-retaining layer for each second amorphous semiconductor layer, and wherein said charge-generating layer is constituted by stacking microcrystalline silicon layers having different crystallinities.

7. An electrophotographic photoreceptor according to claim 1, wherein said charge-generating layer is constituted by stacking amorphous silicon layers and microcrystalline silicon layers.

8. An electrophotographic photoreceptor according to claim 1, wherein said semiconductor layers contain hydrogen.

9. An electrophotographic photoreceptor according to claim 1, wherein said photoconductive layer contains an element belonging to Group III or V of the Periodic Table.

10. An electrophotographic photoreceptor according to claim 1, wherein a barrier layer is formed between said photoconductive layer and said conductive substrate.

11. An electrophotographic photoreceptor according to claim 1, wherein a surface layer is formed on said photoconductive layer.

12. An electrophotographic photoreceptor comprising a conductive substrate, and a photoconductive layer, provided on said conductive substrate, for generating photocarriers upon radiation of light, wherein said photoconductive layer has a charge-generating layer and a charge-retaining layer, said charge-generating layer comprises a multilayered body constituted by alternately stacking amorphous semiconductor layers containing silicon as a major constituent and microcrystalline silicon layers containing silicon as a major constituent, a crystallinity of said microcrystalline silicon layers is changed in a direction of thickness of said charge-generating layer for each microcrystalline silicon layer, and said charge-retaining layer comprises a first amorphous semiconductor layer containing silicon as a major constituent and a second amorphous silicon layer containing silicon as a major constituent and at least one element selected from the group consisting of carbon, oxygen, and nitrogen.

13. An electrophotographic photoreceptor according to claim 12, wherein each of said microcrystalline and amorphous semiconductor layers has a thickness falling within the range of 30 to 500 Å.

14. An electrophotographic photoreceptor according to claim 12, wherein the concentration of said element contained in each of said second amorphous semiconductor layer falls within the range of 0.5 to 30 atomic %.

15. An electrophotographic photoreceptor according to claim 14, wherein the concentration of said element contained in each of said second amorphous semiconductor layer falls within the range of 5 to 30 atomic %.

16. An electrophotographic photoreceptor according to claim 12, wherein the crystallinity of said microcrystalline semiconductor layers is changed within a range of 60 to 90%.

17. An electrophotographic photoreceptor according to claim 12, wherein said semiconductor layers contain hydrogen.

18. An electrophotographic photoreceptor according to claim 12, wherein said photoconductive layer contains an element belonging to Group III or V of the Periodic Table.

19. An electrophotographic photoreceptor according to claim 12, wherein a barrier layer is formed between said photoconductive layer and said conductive substrate.

20. An electrophotographic photoreceptor according to claim 12, wherein a surface layer is formed on said photoconductive layer.

21. An electrophotographic photoreceptor according to claim 7, wherein the crystallinity of said microcrystalline silicon layer is changed in a direction of thickness of said charge-generating layer for each microcrystalline silicon layer.

* * * * *